US012319386B2

(12) United States Patent
Martocchio

(10) Patent No.: US 12,319,386 B2
(45) Date of Patent: Jun. 3, 2025

(54) APPARATUS FOR SECURING WATERCRAFT AGAINST TIDAL ACTION

(71) Applicant: Carmen Martocchio, Manchester, CT (US)

(72) Inventor: Carmen Martocchio, Manchester, CT (US)

( * ) Notice: Subject to any disclaimer, the term of this patent is extended or adjusted under 35 U.S.C. 154(b) by 527 days.

(21) Appl. No.: 17/670,430

(22) Filed: Feb. 12, 2022

(65) Prior Publication Data

US 2023/0219656 A1 Jul. 13, 2023

Related U.S. Application Data

(60) Provisional application No. 63/298,140, filed on Jan. 10, 2022.

(51) Int. Cl.
*B63B 21/04* (2006.01)

(52) U.S. Cl.
CPC ..... *B63B 21/04* (2013.01)

(58) Field of Classification Search
CPC . B63B 21/04; B63B 2021/001; B63B 21/045; B63B 21/06
See application file for complete search history.

(56) References Cited

U.S. PATENT DOCUMENTS

| | | | | |
|---|---|---|---|---|
| 4,742,993 A * | 5/1988 | Montgomery | ..... | B63B 21/04 242/157 R |
| 5,341,757 A | 8/1994 | Digiacomo | | |
| 6,216,625 B1 * | 4/2001 | Baluha | ..... | B63B 21/00 114/230.27 |
| 8,499,710 B2 * | 8/2013 | Marshall | ..... | B63B 21/04 114/230.22 |

* cited by examiner

*Primary Examiner* — Andrew Polay

(57) ABSTRACT

An apparatus for securing watercraft against tidal action, wind and weather has an elongate vertical shaft having a top end and a bottom end and a slide block slidably attached to the elongate vertical shaft. The slide block slides between the top end and the bottom end and has a pair of slots therein and an opening positioned between the slots. The slots and opening are configured to allow a mooring line to be secured to the slide block. A top mounting bracket and bottom mounting bracket are attached to the top end and bottom end, respectively, of the elongate vertical shaft. The top and bottom mounting brackets are configured for attachment to mooring structures. The top mounting bracket includes an integral mooring line hook. A compression spring is mounted on the elongate vertical shaft and seated upon the bottom mounting bracket and absorbs the impact of the slide block.

10 Claims, 15 Drawing Sheets

APPARATUS FOR SECURING WATERCRAFT AGAINST TIDAL ACTION

CROSS-REFERENCE TO RELATED PATENT APPLICATIONS

This application claims the benefit of U.S. provisional application No. 63/298,140, filed Jan. 10, 2022, and entitled "Apparatus for Securing Watercraft Against Tidal Action."

TECHNICAL FIELD

Disclosed herein is an apparatus for securing a watercraft against tidal action.

BACKGROUND

Boats, yachts and other watercraft are typically moored at mooring structures such as dock poles, pilings, docks, piers or other mooring platforms. Such mooring structures may be located in true tidal areas such as oceans, seas or tributaries, or they may be located in waters that exhibit tidal actions dictated by wind and weather, such as rivers and lakes. While moored in a mooring slip, watercraft may be subjected to such tidal action causing significant strain and tension on mooring lines that may result in the severing of the mooring lines causing damage to the watercraft, dock structures and watercraft in adjacent mooring slips. One prior art device developed to address the aforementioned problems is disclosed in U.S. Pat. No. 6,216,625 entitled "Self-Adjusting Tidal Mooring Device" (the "625 patent") and is shown in FIGS. 1-5 herein. Prior art device 1 uses slide block 2 that slides upon vertical slide shaft 3. Prior art device 1 has top mounting bracket 4 that is attached to the top end of vertical slide shaft 3 and bottom mounting bracket 5 that is attached to the bottom end of vertical slide shaft 3. Top mounting bracket 4 and bottom mounting bracket 5 are configured to be attached or mounted to a stationary mooring structure such as a dock pole, piling or portion of a dock. Mooring lines or ropes are attached to the cleats of the watercraft and slide block 2. As the watercraft moves upward or downward in response to tidal action, slide block 2 also slides upward or downward upon vertical slide shaft 3 thereby minimizing slack in the mooring line. One disadvantage of prior art device 1 is that when there is no watercraft in the mooring slip, slide block 2 usually sits in the water where it is vulnerable to accumulation of foreign particles, barnacles and scum. Another disadvantage is that during tidal action that causes sudden downward movement of the watercraft, the slide block 2 slams against bottom mounting bracket 5 thereby causing repetitive, loud noises. Furthermore, the repetitive slamming of slide block 2 against bottom mounting bracket 5 will eventually weaken the point of connection between vertical slide shaft 3 and bottom mounting bracket 5. Referring to FIGS. 2 and 3, prior art device 1 has hook 6 for receiving a mooring line or rope. Hook 6 is a separate component that is welded or brazed to top mounting bracket 4. However, with such a configuration, undue force on the mooring line or rope could cause hook 6 to break off the top mounting bracket 4. Other disadvantages of prior art device 1 reside in the manner in which the top end and bottom end of vertical slide shaft 3 are attached to top mounting bracket 4 and bottom mounting bracket 5, respectively. FIG. 3 shows the top end of vertical slide shaft 3 joined to the bottom side of top mounting bracket 4 via weld 7. However, with such a configuration, undue force on slide block 2 may pull vertical slide shaft 3 laterally with a force that causes breakage or cracking of weld 7. Similarly, FIGS. 4 and 5 show the bottom end of vertical slide shaft 3 joined to the top side of bottom mounting bracket 5 via weld 8. However, with such a configuration, undue force on slide block 2 may pull vertical slide shaft 3 laterally with a force that causes breakage or cracking of weld 8.

What is needed is a new and improved device to secure a watercraft in a mooring slip against tidal action.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

The apparatus for securing a watercraft against tidal action disclosed herein provides numerous improvements and advantages over the device disclosed in the aforementioned U.S. Pat. No. 6,216,625.

In some embodiments, an apparatus for securing watercraft against tidal action comprises an elongate vertical shaft having a top end and a bottom end and a slide block slidably attached to the elongate vertical shaft such that the slide block slides between the top end and the bottom end. The slide block includes a top portion having a first slot, a bottom portion having a second slot and an opening positioned between the slots. The slots and opening are configured to allow a mooring line to be secured to the slide block. The apparatus further comprises a top mounting bracket attached to the top end of the elongate vertical shaft. The top mounting bracket has at least one through-hole sized to receive a fastener for attaching the top mounting bracket to a stationary mooring structure. The top mounting bracket includes an integral mooring line hook. The apparatus further includes a bottom mounting bracket attached to the bottom end of the elongate vertical shaft. The bottom mounting bracket has at least one through-hole sized to receive a fastener for attaching the bottom mounting bracket to the stationary mooring structure. The apparatus further comprises a compression spring mounted on the elongate vertical shaft and seated upon the bottom mounting bracket. The compression spring is configured to absorb the impact of the slide block. The compression spring eliminates any noise that would have been produced if the slide block was allowed to directly impact the bottom mounting bracket. The compression spring also prevents damage to the bottom mounting bracket. The apparatus allows mooring lines to remain snug with minimal slack therein while reducing roll and line shock generated by tidal action and maintaining the spatial position of the watercraft in a mooring slip during the occurrence of such tidal action. In an exemplary embodiment, the apparatus further comprises a slide block retainer member that is attached to the elongate vertical shaft and adjacent to the top mounting bracket. The slide block may be removably secured to the slide block retainer member in order to keep the slide block out of the water when a watercraft is not present in the mooring slip.

Other features, aspects and advantages of the subject matter described herein will become apparent from the following Detailed Description, Figures and Claims.

DETAILED DESCRIPTION

As used herein, the terms "comprise", "comprising", "comprises", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

As used herein, terms such as "vertical", "horizontal", "top", "bottom", "upper", "lower", "middle", "above", "below" and the like are used for convenience in identifying relative locations of various components and surfaces relative to one another in reference to the drawings and are not intended to be limiting in any way.

As used herein, "tidal action" includes rising and falling tides in a body of water such as an ocean, sea or tributary, and wave action caused by winds, weather, flash floods or other environmental factors.

As used herein, "stationary mooring structure" includes dock poles, pilings, docks, portions of a dock or other stationary structure.

Figure 6A:
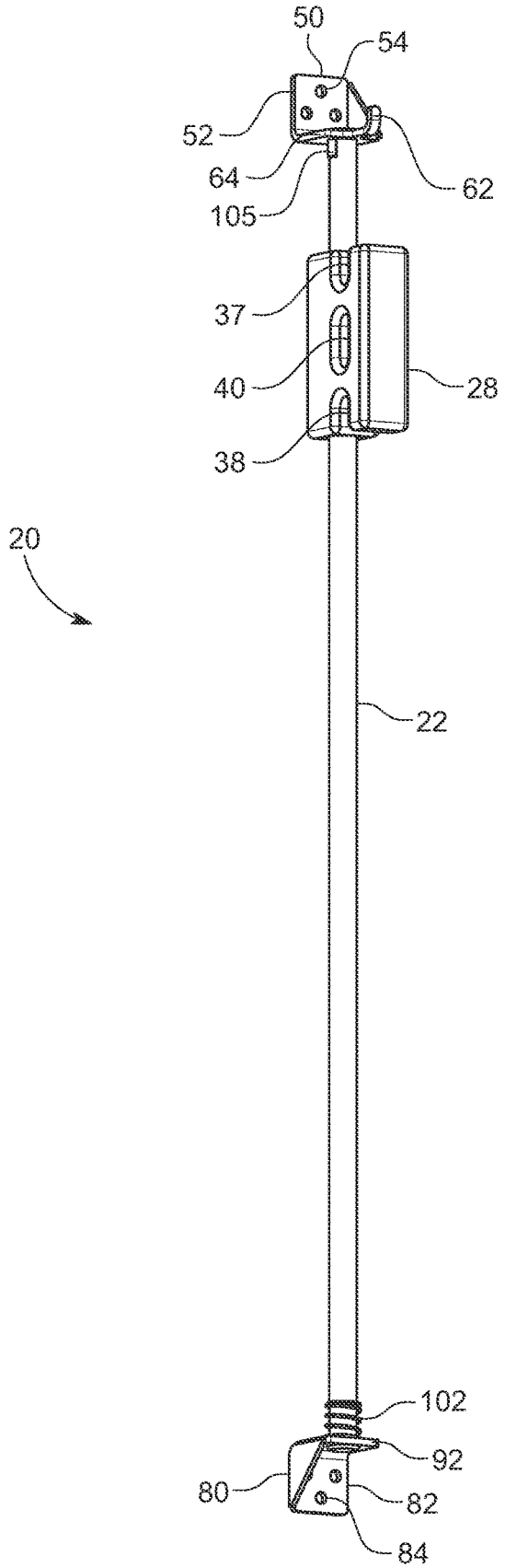
FIG. 6A is a perspective view of an apparatus for securing a watercraft against tidal action in accordance with an exemplary embodiment disclosed herein.
Figure 6B:
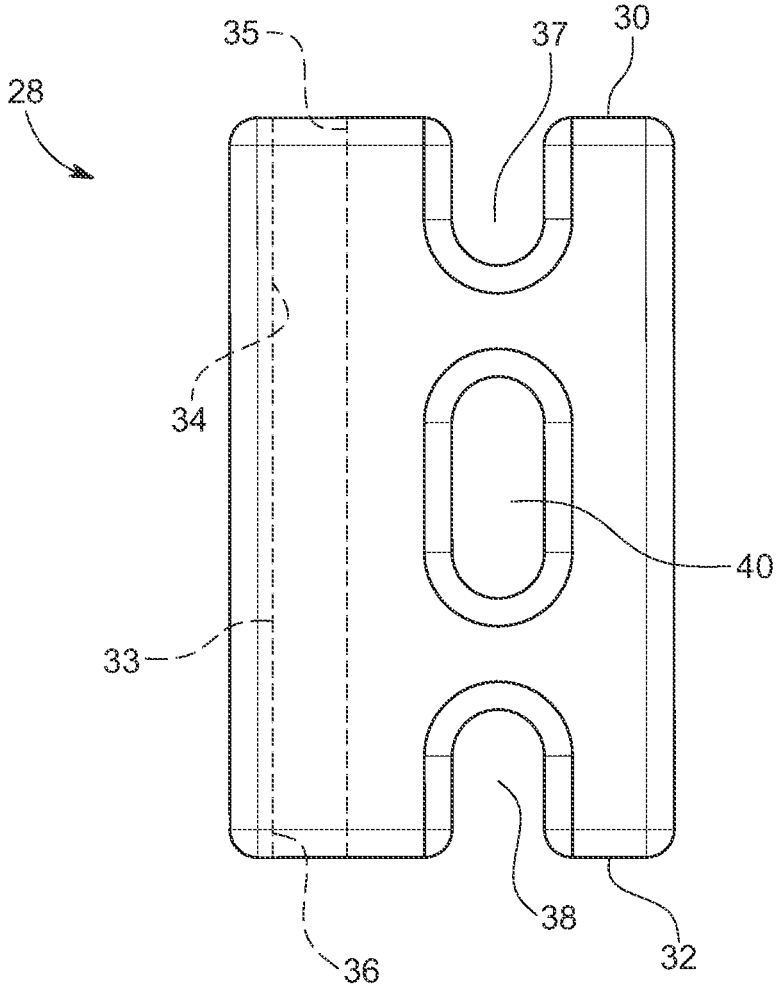
FIG. 6B is a side elevational view of a slide block shown in FIG. 6A.
Figure 7:
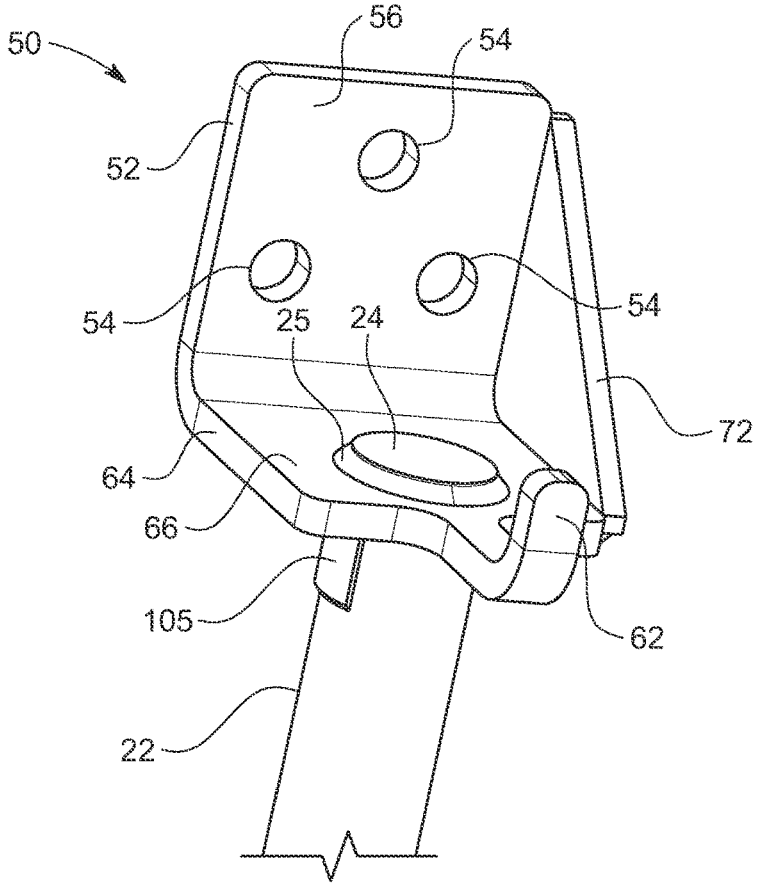
FIG. 7 is a perspective view of a portion of an elongate vertical shaft and a top mounting bracket which are shown in FIG. 6A, wherein the elongate vertical shaft is attached to the top mounting bracket.
Figure 8:
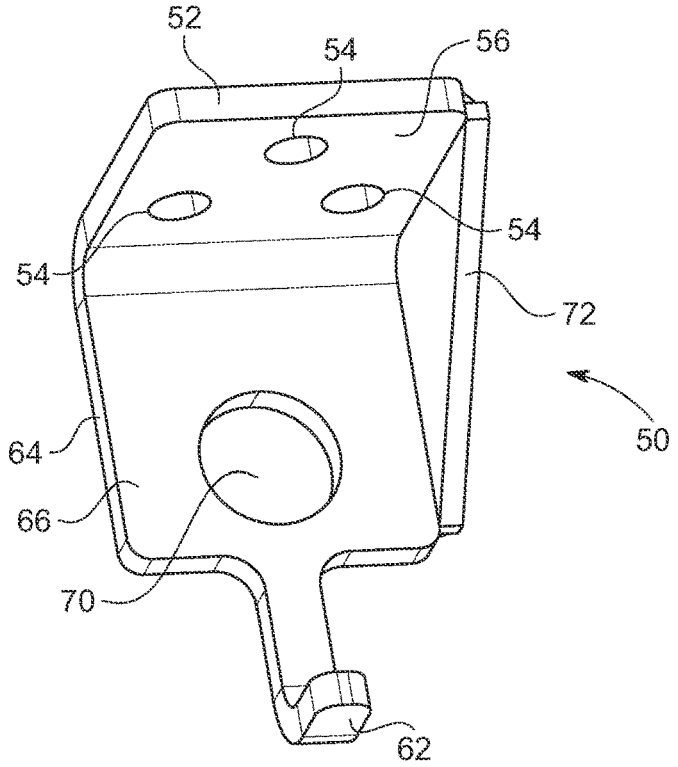
FIG. 8 is a perspective view of the top mounting bracket shown in FIGS. 6A and 7 without the elongate vertical shaft.
Figure 9:
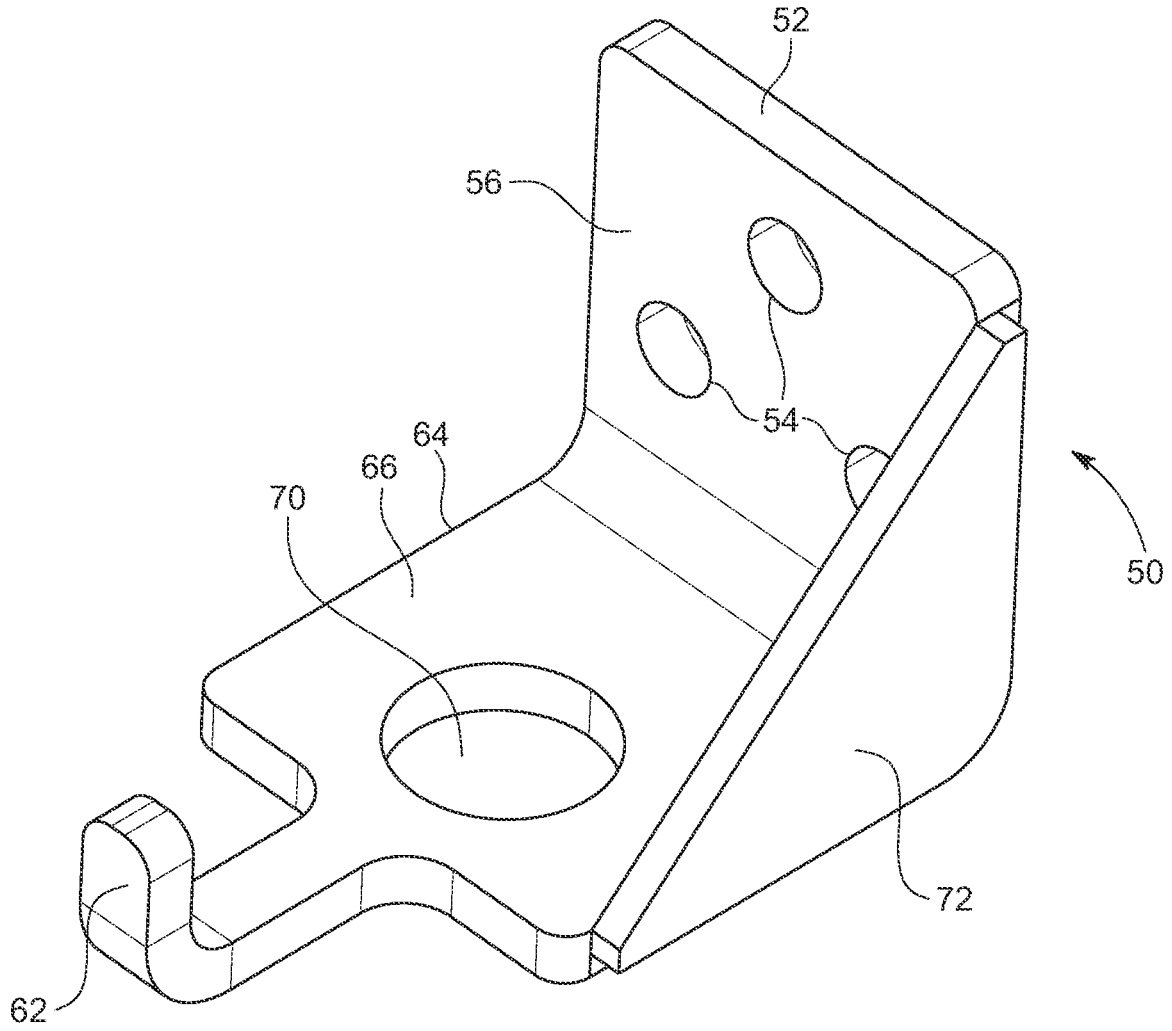
FIG. 9 is another perspective view of the top mounting bracket shown in FIGS. 6A, 7 and 8.

Referring to FIGS. 6A, 6B, 7 and 11, there is shown an apparatus 20 for securing a watercraft against tidal action in accordance with an exemplary embodiment. Apparatus 20 is configured to allow a watercraft in a mooring slip to move vertically with tidal action. Apparatus 20 has elongate vertical shaft 22 that includes top end 24 and bottom end 26. Slide block 28 is slidably attached to elongate vertical shaft 22 such that slide block 28 slides between top end 24 and bottom end 26. As shown in FIG. 6B, slide block 28 has a top end 30, bottom end 32 and bore 33 (shown in phantom) that extends through slide block 28. Slide block bore 33 has interior wall 34 (shown in phantom), first opening 35 (shown in phantom) in top portion 30 and second opening 36 (shown in phantom) in bottom portion 32. Elongate vertical shaft 22 extends through bore 33 such that slide block 28 slides upon elongate vertical shaft 22 and is able to rotate about the longitudinal axis of elongate vertical shaft 22. In an exemplary embodiment, slide block 28 may rotate 360° about the longitudinal axis of elongate vertical shaft 22. Slide block 28 includes first slot 37 in top portion 30 and second slot 38 in bottom portion 32. First slot 37 and second slot 38 are each sized to receive a mooring line. Slide block 28 further includes opening 40 that is spaced apart from bore 33 and is located between top portion 30 and bottom portion 32. Opening 40 is sized to receive a mooring line. In an exemplary embodiment, opening 40 is generally slot-shaped and extends in a direction that is substantially parallel to the longitudinally extending axis of bore 33. During use of apparatus 20, the looped end of the mooring line is passed through opening 40. The looped end is then opened and fitted into slots 37 and 38. As the other end of the mooring line is pulled tight, the looped end closes around slots 37 and 38 thereby securing the mooring line to sliding block 28.

Figure 3:
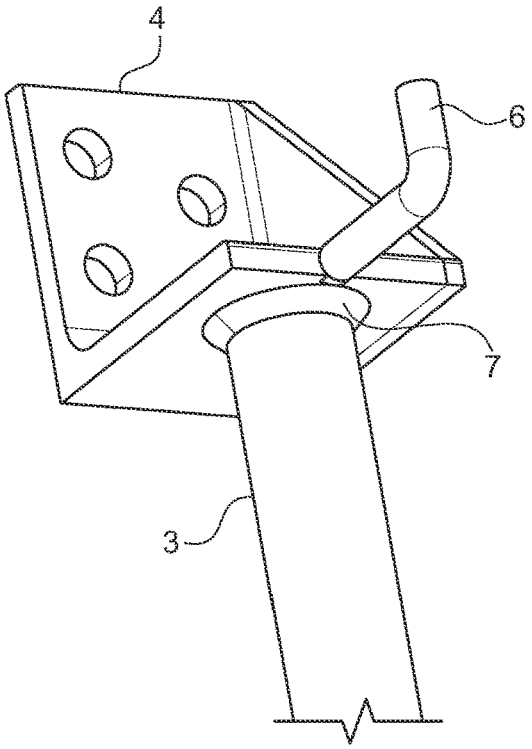
FIG. 3 (PRIOR ART)
FIG. 3 is another perspective view of the top mounting bracket shown in FIG. 2, the view showing the bottom side of the top mounting bracket.
Figure 4:
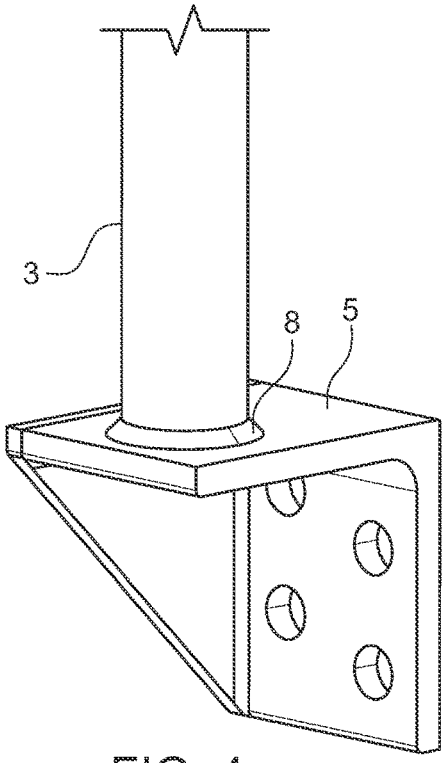
FIG. 4 (PRIOR ART)
FIG. 4 is a perspective view of a bottom mounting bracket of the prior art device of FIG. 1, wherein the vertical slide shaft is attached to the top side of bottom mounting bracket.
Figure 5:
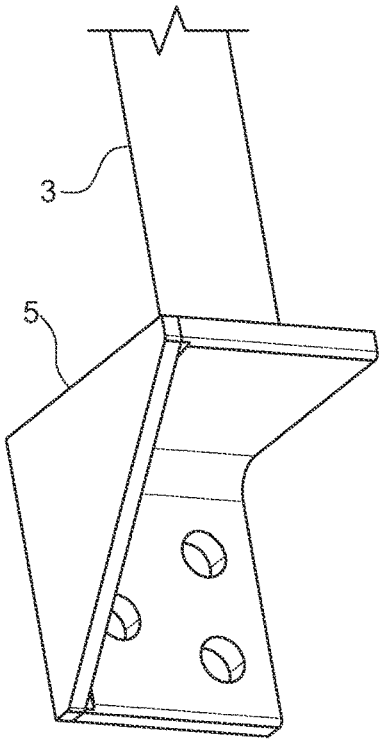
FIG. 5 (PRIOR ART)
FIG. 5 is another perspective view of the bottom mounting bracket shown in FIG. 4, the view showing the bottom side of the bottom mounting bracket.
Figure 12:
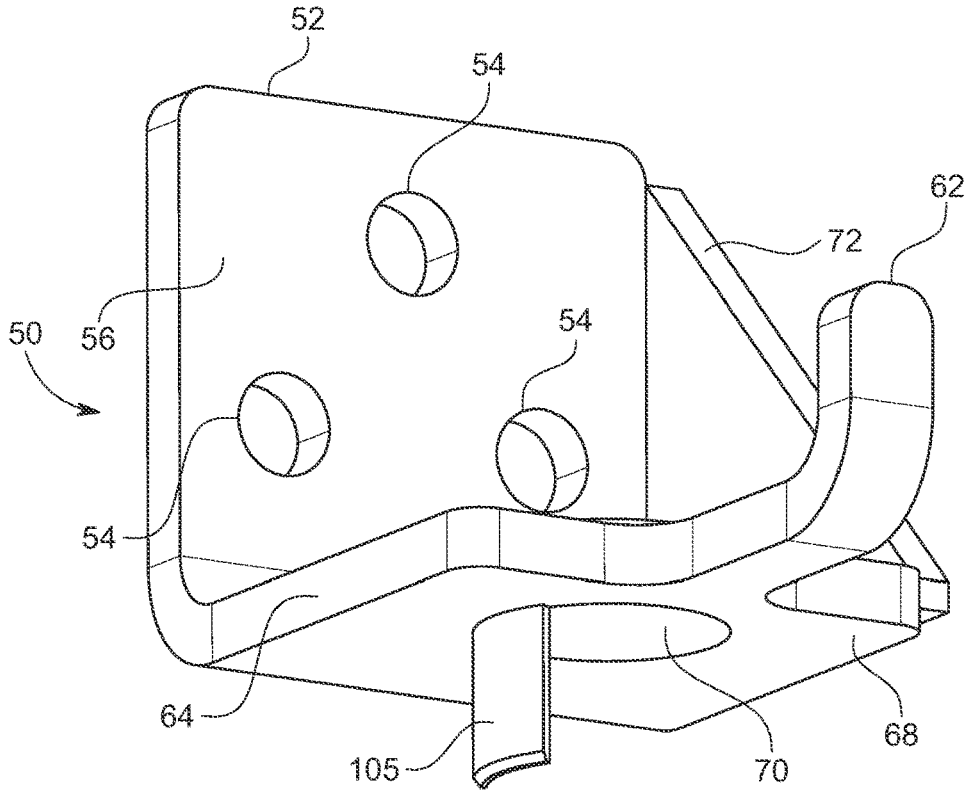
FIG. 12 is another perspective view of the top mounting bracket shown in FIGS. 6A, 7 and 8.
Figure 13:
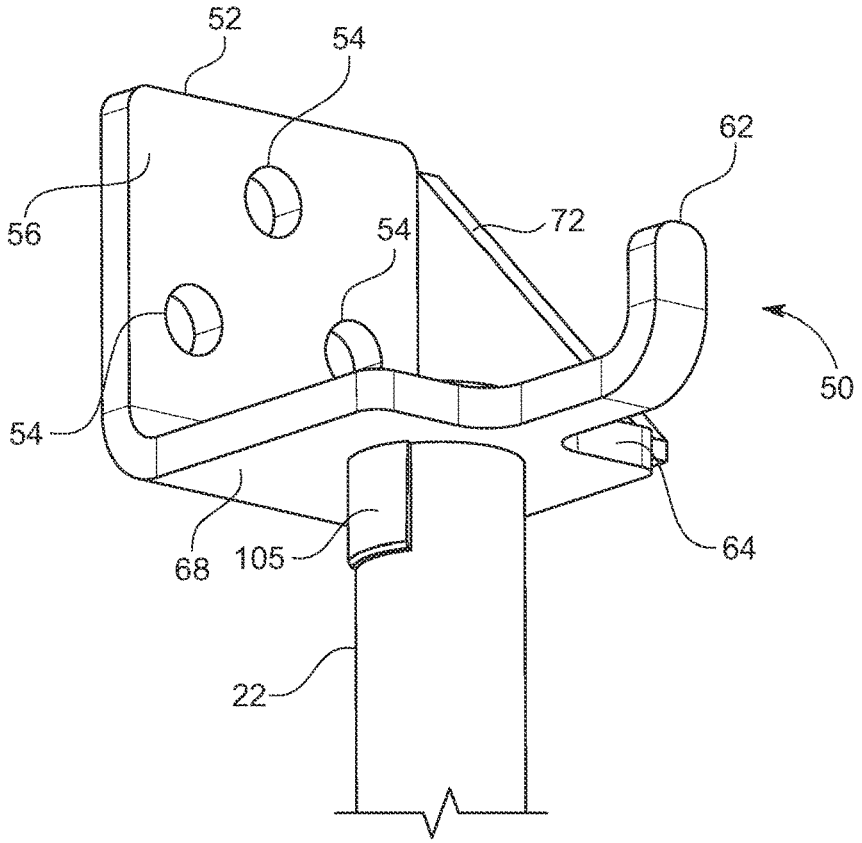
FIG. 13 is a perspective view of the top mounting bracket shown in FIGS. 6A, 7, 8 and 12 having attached thereto the elongate vertical shaft.

Referring to FIGS. 6A and 7-9, top mounting bracket 50 is attached to top end 24 of elongate vertical shaft 22. Top mounting bracket 50 is configured to be attached to stationary mooring structure 200 located in water 201 (see FIGS. 17 and 18). In one example, stationary mooring structure 200 may be a dock pole that is part of a dock structure at which a mooring slip is located. In another example, stationary mooring structure 200 may be a piling. Top mounting bracket 50 comprises first section 52 which has at least one through-hole 54. In an exemplary embodiment, there is a plurality of through-holes 54. First section 52 has front side 56 and an opposite rear side (not shown) which abuts stationary mooring structure 200 when top bracket 50 is attached to stationary mooring structure 200. Each through-hole 54 is sized to receive fastener 60 (see FIG. 17) so as to allow top mounting bracket 50 to be attached to stationary mooring structure 200. Fastener 60 may be any suitable fastening device including, but not limited to, nails, screws and bolts, all of which being large-sized or heavy gauge and fabricated from non-corrosive metals. Top mounting bracket 50 includes integral mooring line hook 62. Mooring line hook 62 is integral with top mounting bracket 50 and is not a separate piece that is attached to top mounting bracket 50. Therefore, mooring line hook 62 has a structural integrity that is significantly higher than the structural integrity of prior art mooring line hook 6 (see FIGS. 3 and 4). Top mounting bracket 50 further comprises second section 64 that is integral with and substantially perpendicular to first section 52. Mooring line hook 62 is integral with second section 64. Second section 64 has top side 66, bottom side 68 (see FIG. 12) and generally central opening 70. A portion of elongate vertical shaft 22 protrudes through opening 70 such that top end 24 of elongate vertical shaft 22 extends just above top side 66. Top end 24 is joined to top side 66. In an exemplary embodiment, top end 24 is welded to top side 66 as shown by weld 25 in FIG. 7. Such a configuration provides improved structural integrity at the point of connection between elongate vertical shaft 22 and top mounting bracket 50. Top mounting bracket 50 further comprises gusset 72 that is joined to first section 52 and second section 64 such that gusset 72 is substantially perpendicular to first section 52 and second section 64. In an exemplary embodiment, gusset 72 is welded to the edges of first section 52 and second section 64.

Figure 10:
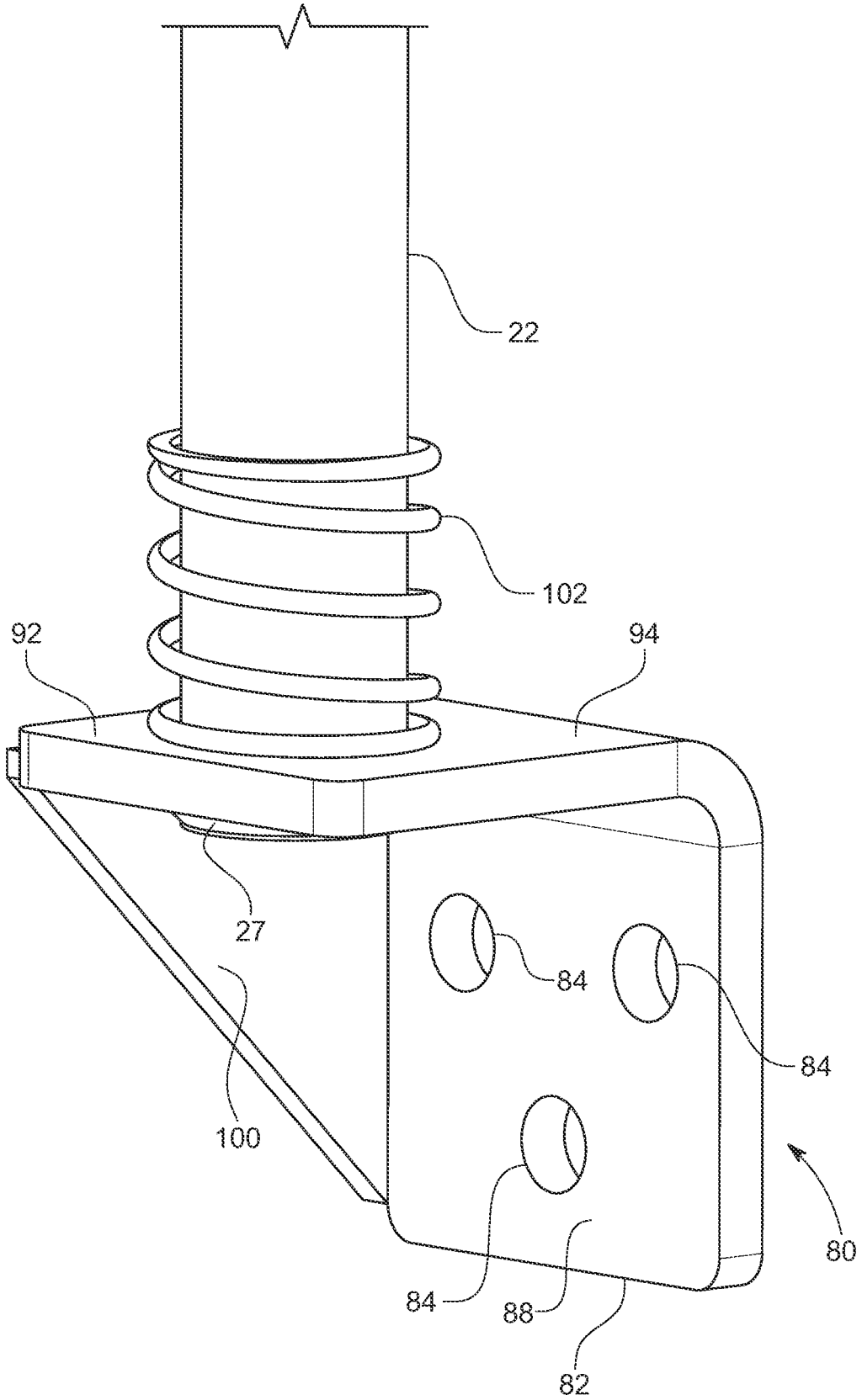
FIG. 10 is a perspective view of a portion of the elongate vertical shaft and a bottom mounting bracket shown in FIG. 6A, wherein the elongate vertical shaft is attached to the bottom mounting bracket and a compression spring is mounted on the elongate vertical shaft and seated upon the bottom mounting bracket.
Figure 11:
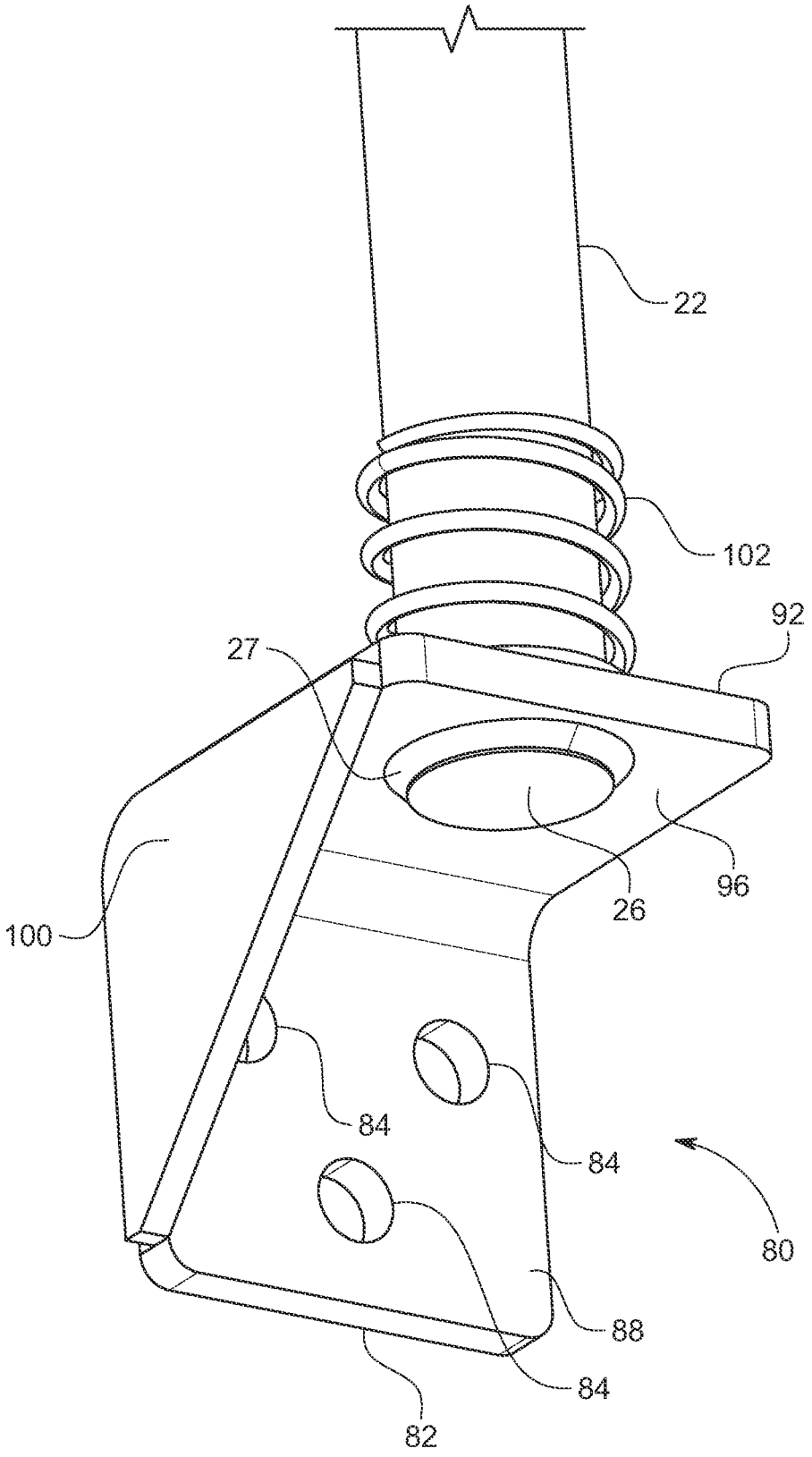
FIG. 11 is another perspective view of the bottom mounting bracket and compression spring shown in FIG. 10.
Figure 17:
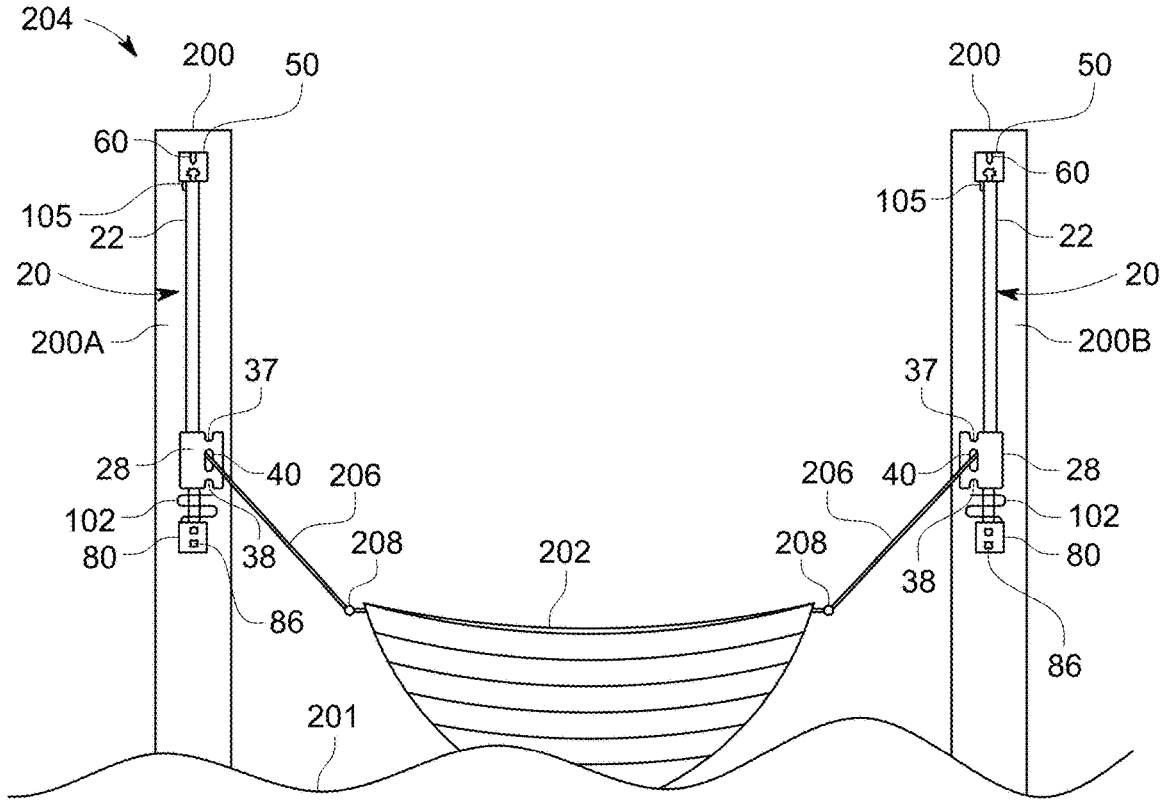
FIG. 17 is an elevational view showing a watercraft in a mooring slip at low tide and secured by two of the apparatus shown in FIG. 6A, wherein each apparatus is attached to a corresponding dock pole and separate mooring lines are attached to the watercraft and the slide block of each apparatus, each slide block being at a relatively low position on the elongate vertical shaft.

Referring to FIGS. 6A, 10 and 11, apparatus 20 further comprises bottom mounting bracket 80 that is attached to bottom end 26 of elongate vertical shaft 22. Bottom mounting bracket 80 is configured to be attached to stationary mooring structure 200 (see FIG. 17). Bottom mounting bracket 80 comprises first section 82 which has at least one through-hole 84. In an exemplary embodiment, there is a plurality of through-holes 84. Each through-hole 84 is sized to receive fastener 86 which allows bottom mounting bracket 80 to be attached to stationary mooring structure 200 (FIG. 17). Fastener 86 may be any suitable fastening device including, but not limited to, nails, screws and bolts, all of which being large-sized or heavy gauge and fabricated from non-corrosive metals. First section 82 has front side 88 and an opposite rear side (not shown) that abuts stationary mooring structure 200 when bottom mounting bracket 80 is attached to stationary mooring structure 200. Bottom mounting bracket 80 further comprises second section 92 that is integral with and substantially perpendicular to first section 82. Second section 92 has top side 94 and bottom side 96. Second section 92 includes a central opening through which a portion of elongate vertical shaft 22 protrudes such that bottom end 26 of elongate vertical shaft 22 extends a distance away from bottom side 96. Bottom end 26 of elongate vertical shaft 22 is joined to bottom side 96. In an exemplary embodiment, bottom end 26 is welded to bottom side 96 as indicated by weld 27 (see FIGS. 10 and 11). Such a configuration provides improved structural integrity at the point of connection between elongate vertical shaft 22 and bottom mounting bracket 80. Bottom mounting bracket 80 further comprises gusset 100 that is joined to first section 82 and second section 92. Gusset 100 is substantially perpendicular to first section 82 and second section 92. In an exemplary embodiment, gusset 100 is welded to the edges of first section 82 and second section 92.

Apparatus 20 further includes compression spring 102 that is mounted on elongate vertical shaft 22 and is seated upon second section 92 of bottom mounting bracket 80. Compression spring 102 absorbs the impact of slide block 28 thereby preventing the slide block 28 from slamming into second section 92 of bottom mounting bracket 80. Thus, compression spring 102 absorbs the impact of slide block 28 and minimizes or eliminates noise that would have been produced if the slide block 28 directly slammed into the bottom mounting bracket 80 during tidal action. Compression spring 102 also prevents damage to bottom mounting bracket 80. In an exemplary embodiment, compression spring 102 is fabricated from non-corrosive metal.

Referring to FIGS. 6A, 7, 12 and 13, in an exemplary embodiment, top mounting bracket 50 includes downwardly extending member 105 that is joined or attached to second section 64 of top mounting bracket 50. In some embodiments, downwardly extending member 105 is joined or attached to bottom side 68 of second section 64 such that downwardly extending member 105 is adjacent to elongate vertical shaft 22. In some embodiments, downwardly extending member 105 abuts or contacts elongate vertical shaft 22. Downwardly extending member 105 is sized to frictionally fit within the available space within first opening 35 in bore 33 of slide block 28. Thus, insertion of downwardly extending member 105 into first opening 35 creates a frictional relationship with interior wall 34 of bore 33 which allows slide block 28 to be held adjacent to top mounting bracket 50 and away from the water thereby preventing unnecessary accumulation of barnacles, scum and other particles on slide block 28. Any suitable method may be used to attach or join downwardly extending member 105 to second section 64. In one embodiment, downwardly extending member 105 is welded to bottom side 68 of second section 64. In an exemplary embodiment, downwardly extending member 105 is substantially wedge-shaped.

In other embodiments, elongate vertical shaft 22 is configured to have an integral, downwardly extending wedge-shaped portion that is adjacent to top end 24 and performs the same function as downwardly extending member 105. In further embodiments, a downwardly extending wedge-shaped member is joined or attached to elongate vertical shaft 22 near top end 24 via any suitable technique, e.g. welding, brazing, rivets, etc.

Figure 1:
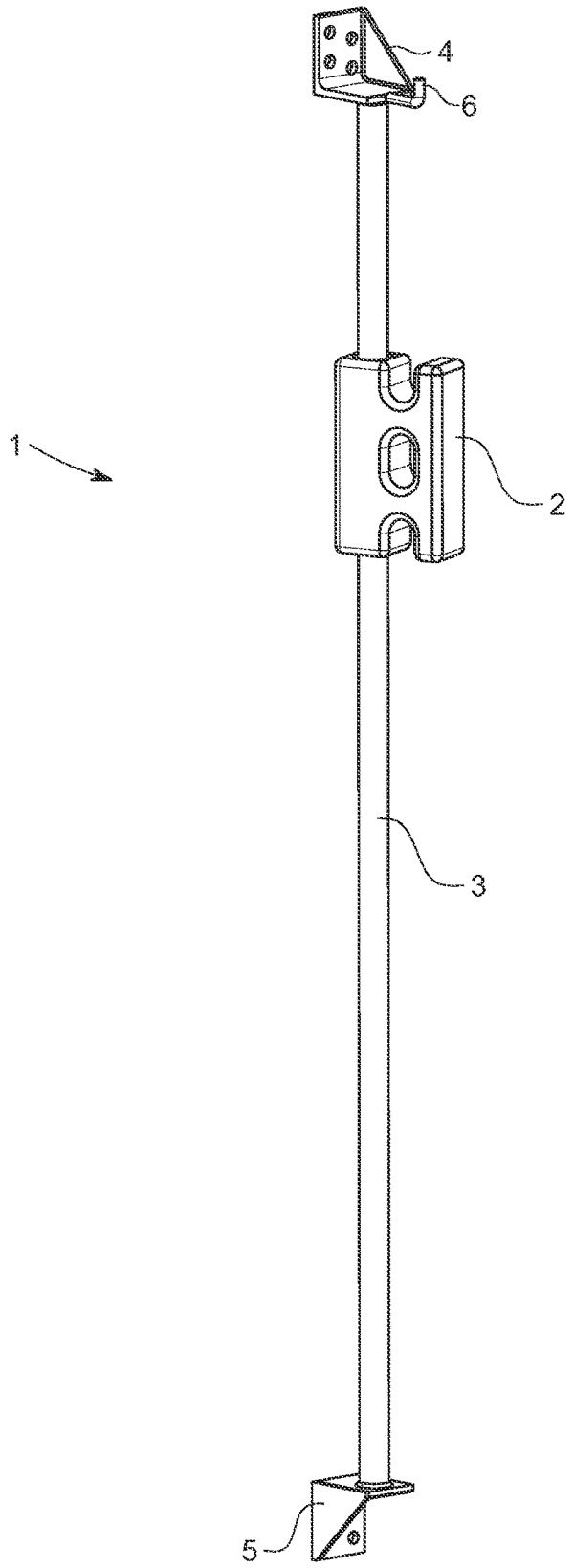
FIG. 1 (PRIOR ART)
FIG. 1 is a perspective view of a prior art self-adjusting tidal mooring device.
Figure 2:
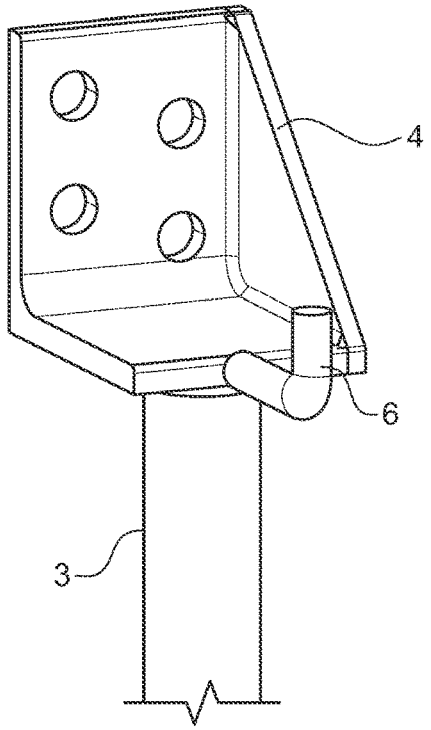
FIG. 2 (PRIOR ART)
FIG. 2 is a perspective view of a portion of a vertical slide shaft and top mounting bracket, both of which being part of the prior art device of FIG. 1.
Figure 14:
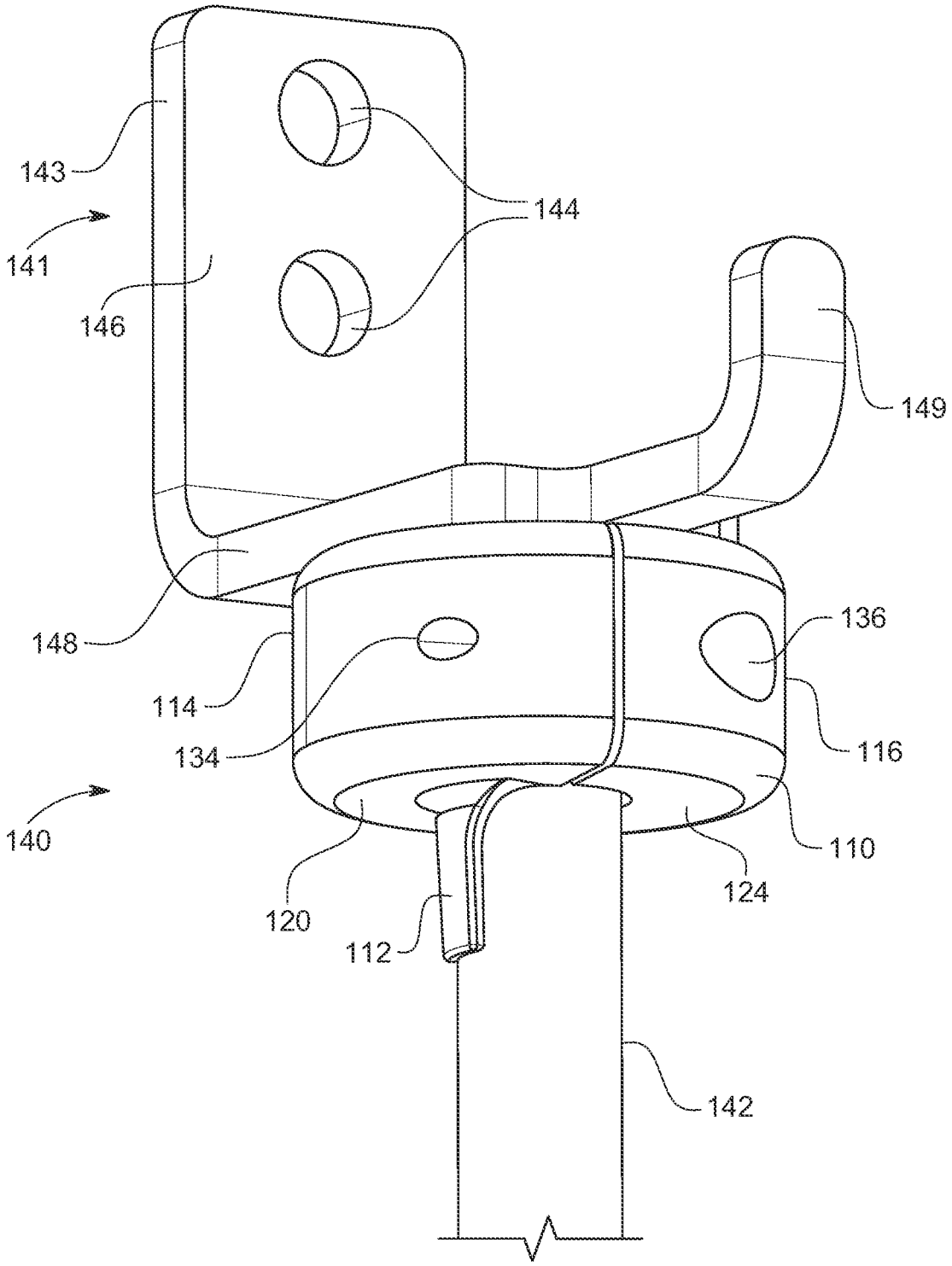
FIG. 14 is a partial, perspective view of an apparatus for securing a watercraft against tidal action in accordance with another exemplary embodiment.
Figure 15:
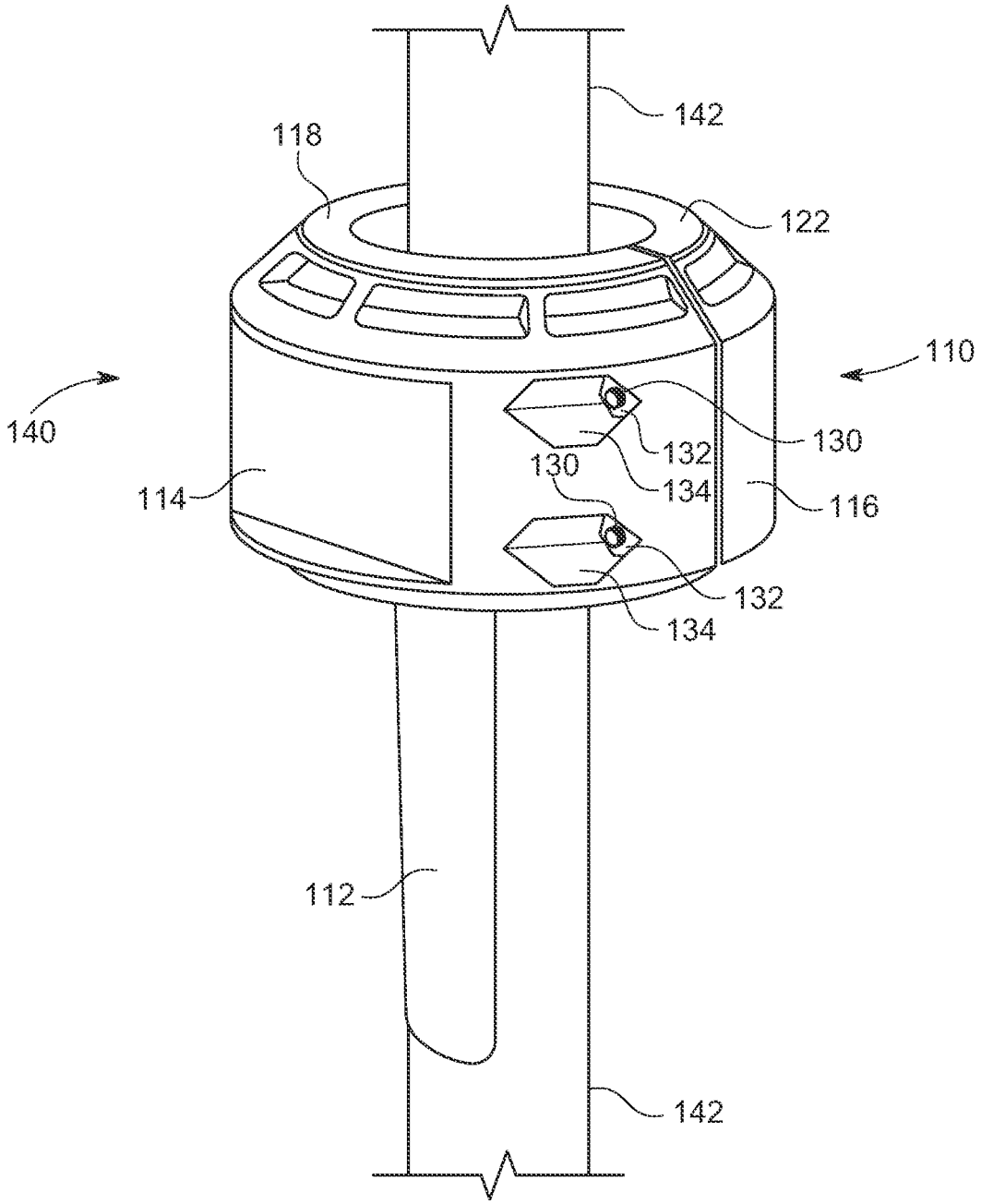
FIG. 15 is a perspective view of a slide block retainer member shown in FIG. 14.
Figure 16:
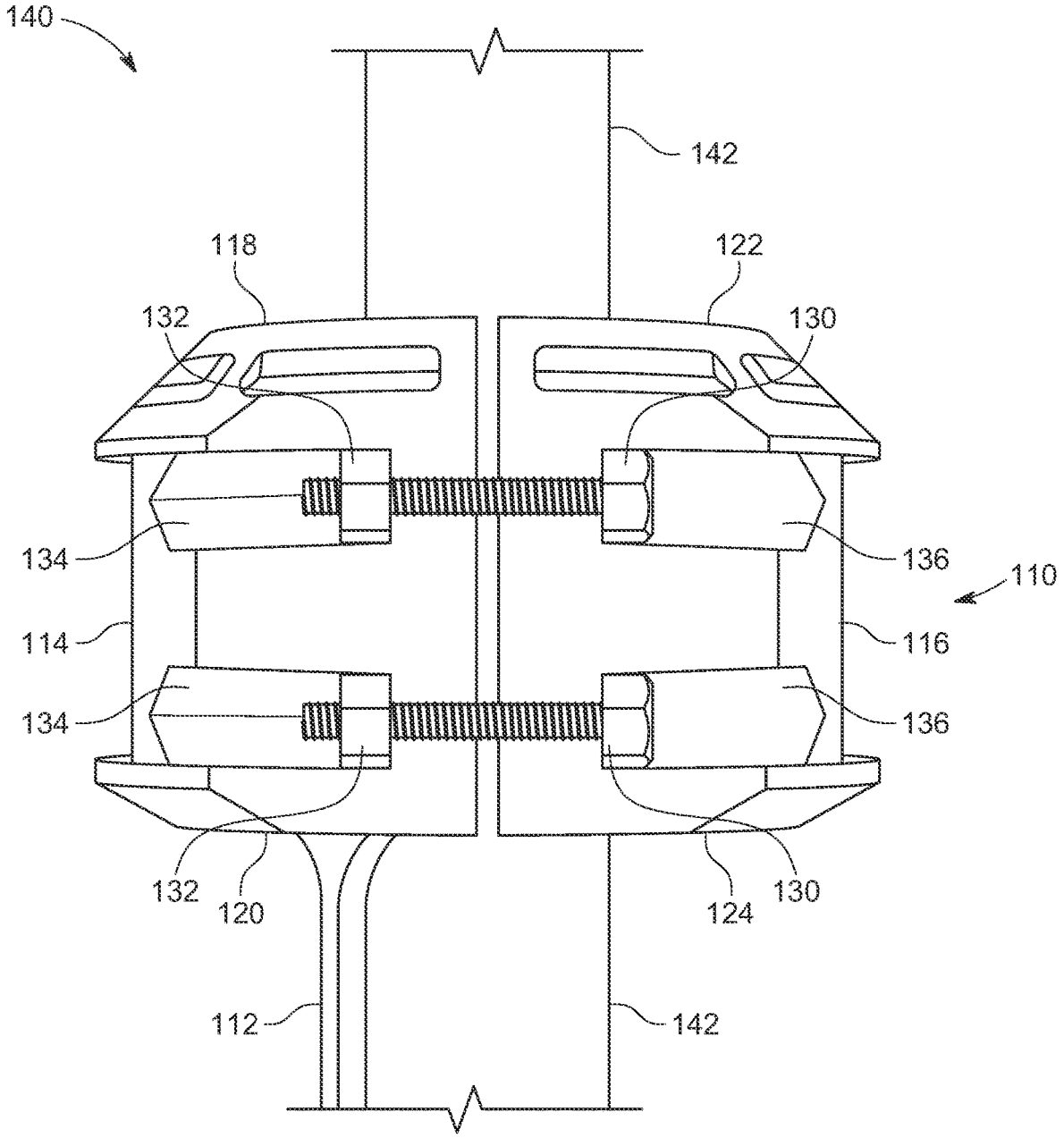
FIG. 16 is a rear perspective view of the slide block retainer member shown in FIG. 14.

Referring to FIGS. 14-16, there is shown a partial view of apparatus 140 for securing watercraft against tidal action in accordance with another exemplary embodiment. Apparatus 140 comprises top mounting bracket 141 and elongate vertical shaft 142. Top mounting bracket 141 has a different configuration than top mounting bracket 50. Top mounting bracket 141 comprises first section 143 which has at least one through-hole 144. In an exemplary embodiment, there is a plurality of through-holes 144. Each through-hole 144 is sized to receive a fastener (not shown) so as to allow top mounting bracket 141 to be attached to stationary mooring structure 200. First section 143 has front side 146 and an opposite rear side (not shown) which abuts stationary mooring structure 200 when top mounting bracket 141 is attached to stationary mooring structure 200. Top mounting bracket 141 further comprises second section 148 that is integral with and substantially perpendicular to first section 143. Second section 148 has a central opening (not shown) through which a portion of elongate vertical shaft 142 protrudes. Elongate vertical shaft 142 has the same purpose and structure as elongate vertical shaft 22. Elongate vertical shaft 142 has a top end (not shown) that is joined to second section 148 in the same manner in which top end 24 of elongate shaft 22 is joined to second section 64 of top mounting bracket 50. Such a configuration provides improved structural integrity at the point of connection between elongate vertical shaft 142 and top mounting bracket 141. Top mounting bracket 141 includes integral mooring line hook 149. Mooring line hook 149 is integral with second section 148 and is formed during the formation of top mounting bracket 141. Thus, mooring line hook 149 is not a separate piece that is subsequently attached to second section 148. Therefore, mooring line hook 149 has a structural integrity that is significantly higher than mooring line hook 6 (see FIGS. 2 and 3). Mooring line hook 149 has the same function as mooring line hook 62. Apparatus 140 has a bottom mounting bracket (not shown) that is attached the bottom end of elongate vertical shaft 142. The bottom mounting bracket of apparatus 140 has the same structure, function and purpose as that of bottom mounting bracket 80 of apparatus 20. Apparatus 140 includes a slide block (not shown) that has the same structure, function and purpose as that of slide block 28 of apparatus 20. Therefore, apparatus 140 may use the same slide block 28. Slide block 28 is pivotable or rotatable about the longitudinal axis of elongate vertical shaft 142. In order to facilitate understanding of this embodiment, the ensuing description is in terms of apparatus 140 utilizing slide block 28.

Apparatus 140 further comprises slide block retainer member 110. The purpose of slide block retainer member 110 is to retain the slide block near the upper portion of elongate vertical shaft 142 so that the slide block does not have to reside in the water when the watercraft is not present in the mooring slip. Slide block retainer member 110 is attached to elongate vertical shaft 142 and adjacent to top mounting bracket 141. In an exemplary embodiment, slide block retainer member 110 is removably attached to elongate vertical shaft 142. Slide block retainer member 110 includes downwardly extending member 112. Downwardly extending member 112 is adjacent to vertical shaft 142. In some embodiments, downwardly extending member 112 physically contacts vertical shaft 142. Downwardly extending member 112 is configured to frictionally fit within first opening 35 of bore 33 in slide block 28 so that downwardly extending member 112 tightly abuts the interior wall 34 of bore 33 in order to allow slide block 28 to be held adjacent to top mounting bracket 141. A user may manually move slide block 28 upward so that downwardly extending member 112 enters first opening 35 so as to retain slide block 28 adjacent to top mounting bracket 141. In order to free slide block 28 from downwardly extending member 112, the user may manually pull or push slide block 28 downward with sufficient force to overcome the tight fitting relationship between downwardly extending member 112 and interior wall 34. In an exemplary embodiment, downwardly extending member 112 is configured to have a shape of a wedge so as to facilitate insertion into first opening 35.

In an exemplary embodiment, slide block retainer member 110 comprises a pair of generally semi-circular shaped sections 114 and 116 that are attached or joined together. Each section 114 and 116 has a notched portion so that when sections 114 and 116 are attached together, elongate vertical shaft 142 fits into the notched portions. Section 114 has top portion 118 and bottom portion 120. Similarly, section 116 has top portion 122 and bottom portion 124. As shown in FIG. 16, downwardly extending member 112 extends from bottom portion 120 of section 114. In an exemplary embodiment, sections 114 and 116 are removably attached together with bolts 130 and nuts 132. In an exemplary embodiment, bolts 130 and nuts 132 are fabricated from non-corrosive metals, such as stainless steel. In an exemplary embodiment, section 114 has bores or interior channels 134 to receive bolts 130 and nuts 132. Section 116 has bores or interior channels 136 to receive bolts 130.

Figure 18:
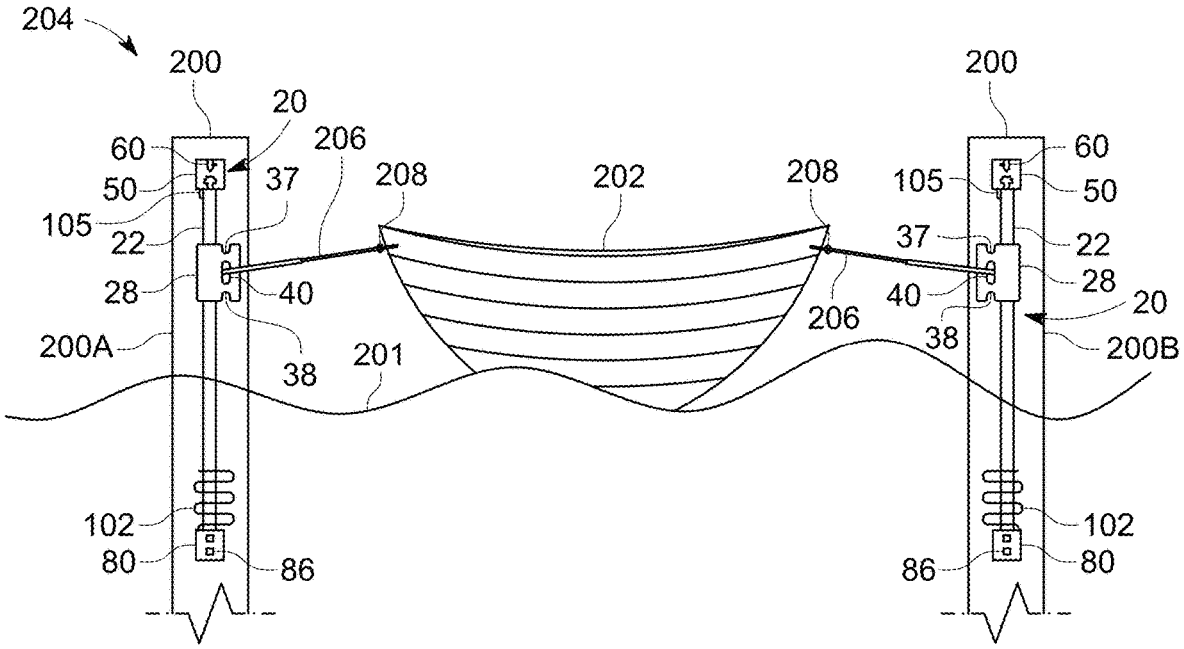
FIG. 18 is an elevational view showing the watercraft at high tide and the slide blocks at relatively higher positions on the elongate vertical shafts.
Figure 19:
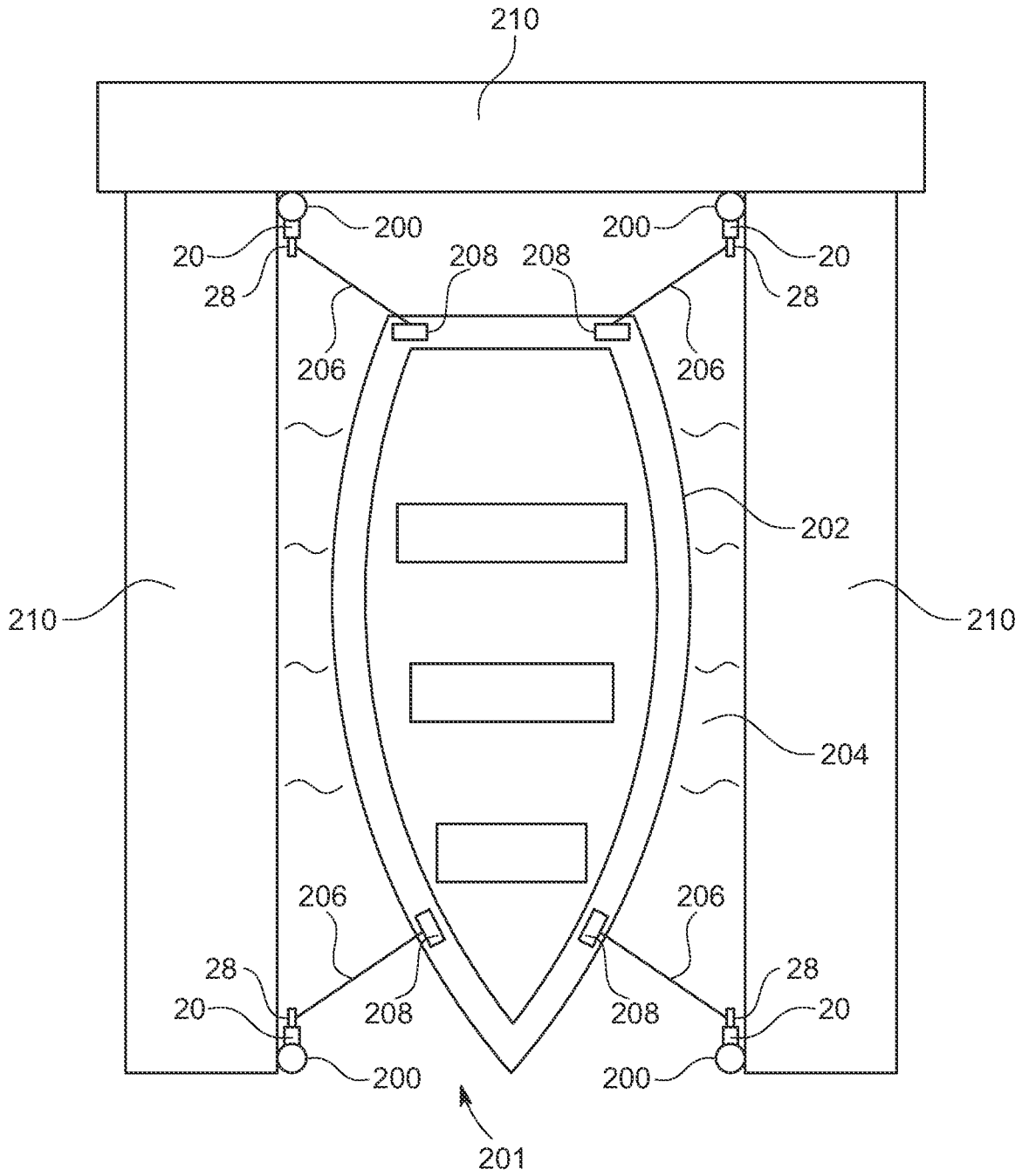
FIG. 19 is a top view of a watercraft in a mooring slip and secured by four of the apparatus shown in FIG. 6A, wherein each apparatus is attached to a corresponding dock pole and a separate mooring line is attached to the slide block of each apparatus and the watercraft.

Referring to FIGS. 17-18, there is shown two apparatuses 20 used to secure a watercraft against tidal action. Each apparatus 20 is attached or joined to a corresponding mooring structure 200, which may be a dock pole or piling. Each elongate vertical shaft 22 is spaced apart from mooring structure 200 by top mounting bracket 50 and bottom mounting bracket 80 so as to allow slide block 28 to slide up and down elongate vertical shaft 22 and to pivot about the longitudinal axis of elongate vertical shaft 22. The ability of slide block 28 to pivot about the longitudinal axis of elongate vertical shaft 22 allows apparatus 20 to be used with large, medium or small sized watercraft. In other embodiments, top mounting bracket 50 and bottom mounting bracket 80 are configured so that elongate vertical shaft 22 is spaced a sufficient distance from mooring structure 200 so as to allow slide block 28 to rotate 360° about the longitudinal axis of elongate vertical shaft 22. In the example shown in FIGS. 17 and 18, each apparatus 20 is used on a corresponding side of watercraft 202. One apparatus 20 is attached to dock pole 200A and the other apparatus 20 is attached to the opposite dock pole 200B. FIG. 17 shows watercraft 202 securely positioned in mooring slip 204 at low tide. Mooring lines 206 are secured to cleats 208 on watercraft 202 and the slide block 28 of each apparatus 20. Each slide block 28 is approaching its lower travel limit on elongate vertical shaft 22 and is in close proximity to compression spring 102. The view shown in FIG. 17 is that of the rear of watercraft 202. Each apparatus 20 minimizes or eliminates slack in mooring lines 206 and maintains a slight degree of tension in mooring lines 206. FIG. 18 shows watercraft 202 securely positioned in mooring slip 204 at high tide. Watercraft 202 is now at a higher position. As the tide rose, the upward vertical movement of watercraft 202 caused slide blocks 28 to move upward on elongate vertical shafts 22. Slide blocks 28 still maintain substantially the same degree of tension in mooring lines 206 as during low tide. Referring to FIG. 19, watercraft 202 is positioned within mooring slip 204 formed by dock structure 210. An apparatus 20 is attached to each of the four dock poles 200 so that two apparatuses 20 are used at the front end of watercraft 202 and two apparatuses 20 are used at the rear of watercraft 202. The apparatuses 20 maintain the spatial position of watercraft 202 in mooring slip 204 while allowing watercraft 202 to move vertically with tidal action.

FIGS. 17-19 demonstrate the use of apparatus 20 to secure watercraft 202 within mooring slip 204. However, in the alternative, a plurality of apparatuses 140 may be attached to corresponding mooring structures 200 in the same manner so as to secure watercraft 202 within mooring slip 204.

In an exemplary embodiment, the top and bottom mounting brackets and the elongate vertical shafts of apparatuses 20 and 140 are fabricated from non-corrosive metals. An example of such a corrosive metal is stainless steel. In some embodiments, the slide blocks (e.g. slide block 28) are fabricated from a material chosen from the group comprising polyethylene, plastic, rubber, resin, PVC (polyvinylchloride), polycarbonate, composites or any combination thereof. In an exemplary embodiment, the slide blocks are fabricated from an elastomeric material.

The foregoing description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An apparatus for securing watercraft against tidal action comprising:

an elongate vertical shaft having a top end and a bottom end;

a slide block slidably attached to the elongate vertical shaft such that the slide block slides between the top end and the bottom end, the slide block having a top portion having a first slot and a bottom portion having a second slot, the slide block having an opening between the first slot and second slot, wherein the first slot, second slot and opening are configured to allow a mooring line to be secured to the slide block;

a top mounting bracket attached to the top end of the elongate vertical shaft and configured for attachment to a stationary mooring structure, the top mounting bracket having an integral mooring line hook, wherein the top mounting bracket comprises a first section having a front side and an opposite rear side which contacts the stationary mooring structure, and a second section integral with and substantially perpendicular to the first section, the mooring line hook being integral with the second section, wherein the second section of the top mounting bracket has a top side, a bottom side and a generally centrally located opening through which a portion of the elongate vertical shaft protrudes such that the top end of the elongate vertical shaft is above the top surface, wherein said top end is joined to the top side of the second section;

a bottom mounting bracket attached to the bottom end of the elongate vertical shaft and configured for attachment to the stationary mooring structure;

a compression spring mounted on the elongate vertical shaft and seated upon the bottom mounting bracket, whereby the compression spring absorbs the impact of the slide block so as to reduce noise and prevent damage to the bottom mounting bracket; and wherein the apparatus for securing watercraft against tidal action allows mooring lines to remain snug with minimal slack therein while reducing roll and line shock generated by tidal action and maintaining the spatial position of the watercraft in a mooring slip during the occurrence of such tidal action.

2. The apparatus according to claim 1 wherein the top mounting bracket further comprises a gusset joined to the first section and the second section, wherein the gusset is substantially perpendicular to the first section and the second section.

3. An apparatus for securing watercraft against tidal action comprising:

an elongate vertical shaft having a top end and a bottom end;

a slide block slidably attached to the elongate vertical shaft such that the slide block slides between the top end and the bottom end, the slide block having a top portion having a first slot and a bottom portion having a second slot, the slide block having an opening between the first slot and second slot, wherein the first slot, second slot and opening are configured to allow a mooring line to be secured to the slide block, the slide block having a length, a top portion, a bottom portion and an internal bore that extends for the length, the internal bore having a first opening in the top portion of the slide block and a second opening in the bottom portion of the slide block, wherein the elongate vertical shaft extends through the internal bore and the first opening and the second opening such that the slide block slides upon the elongate vertical shaft;

a top mounting bracket attached to the top end of the elongate vertical shaft and configured for attachment to a stationary mooring structure, the top mounting bracket having an integral mooring line hook, the top mounting bracket including a downwardly extending member configured to frictionally fit within the first opening of the slide block, whereby insertion of the downwardly extending member into the top opening of the slide block creates a frictional relationship between the slide block and the downwardly extending member which holds the slide block adjacent to the top mounting bracket;

a bottom mounting bracket attached to the bottom end of the elongate vertical shaft and configured for attachment to the stationary mooring structure;

a compression spring mounted on the elongate vertical shaft and seated upon the bottom mounting bracket, whereby the compression spring absorbs the impact of the slide block so as to reduce noise and prevent damage to the bottom mounting bracket; and wherein the apparatus for securing watercraft against tidal action allows mooring lines to remain snug with minimal slack therein while reducing roll and line shock generated by tidal action and maintaining the spatial position of the watercraft in a mooring slip during the occurrence of such tidal action.

4. The apparatus according to claim 3 wherein the downwardly extending member is substantially wedge shaped.

5. An apparatus for securing watercraft against tidal action comprising:

an elongate vertical shaft having a top end and a bottom end;

a slide block slidably attached to the elongate vertical shaft such that the slide block slides between the top end and the bottom end, the slide block having a top portion having a first slot and a bottom portion having a second slot, the slide block having an opening between the first slot and second slot, wherein the first slot, second slot and opening are configured to allow a mooring line to be secured to the slide block, the slide block having a length, a top portion, a bottom portion and an internal bore that extends for said length, the internal bore having a first opening in the top portion of the slide block and a second opening in the bottom portion of the slide block, wherein the elongate vertical shaft extends through the internal bore and the first opening and the second opening such that the slide block slides upon the elongate vertical shaft;

a top mounting bracket attached to the top end of the elongate vertical shaft and configured for attachment to a stationary mooring structure, the top mounting bracket having an integral mooring line hook;

a bottom mounting bracket attached to the bottom end of the elongate vertical shaft and configured for attachment to the stationary mooring structure;

a compression spring mounted on the elongate vertical shaft and seated upon the bottom mounting bracket, whereby the compression spring absorbs the impact of the slide block so as to reduce noise and prevent damage to the bottom mounting bracket;

a slide block retainer member attached to the elongate vertical shaft and adjacent to the top mounting bracket, the slide block retaining member having a downwardly extending member adjacent to the elongate vertical shaft and configured to frictionally fit within the first opening of the slide block, whereby insertion of the downwardly extending member into the top opening of the slide block creates a frictional relationship between the slide block and the downwardly extending member which holds the slide block adjacent to the top mounting bracket; and wherein the apparatus for securing watercraft against tidal action allows mooring lines to remain snug with minimal slack therein while reducing roll and line shock generated by tidal action and maintaining the spatial position of the watercraft in a mooring slip during the occurrence of such tidal action.

6. The apparatus according to claim 5 wherein the slide block retainer member is substantially circular in shape and has a substantially centrally located bore extending therethrough, a top portion and a bottom portion, wherein the downwardly extending member is attached to the bottom portion and wherein the elongate vertical shaft extends through the substantially centrally located bore.

7. The apparatus according to claim 6 wherein the downwardly extending member is substantially wedge shaped.

8. The apparatus according to claim 5 wherein the slide block retainer member comprises two sections that are joined together.

9. An apparatus for securing watercraft against tidal action comprising:

an elongate vertical shaft having a top end and a bottom end;

a slide block slidably attached to the elongate vertical shaft such that the slide block slides between the top end and the bottom end, the slide block having a top portion having a first slot and a bottom portion having a second slot, the slide block having an opening between the first slot and second slot, wherein the first slot, second slot and opening are configured to allow a mooring line to be secured to the slide block;

a top mounting bracket attached to the top end of the elongate vertical shaft and configured for attachment to a stationary mooring structure, the top mounting bracket having an integral mooring line hook;

a bottom mounting bracket attached to the bottom end of the elongate vertical shaft and configured for attachment to the stationary mooring structure, the bottom mounting bracket comprising a first section having a front side and an opposite rear side which contacts the stationary mooring structure, the bottom mounting bracket further comprising a second section integral with and substantially perpendicular to the first section, wherein the second section of the bottom mounting bracket has a top side, a bottom side and a generally central opening through which a portion of the elongate vertical shaft protrudes such that the bottom end of the elongate vertical shaft extends beyond the bottom side, wherein the bottom end of the elongate vertical shaft is joined to the bottom side of the second section;

a compression spring mounted on the elongate vertical shaft and seated upon the bottom mounting bracket, whereby the compression spring absorbs the impact of the slide block so as to reduce noise and prevent damage to the bottom mounting bracket; and wherein the apparatus for securing watercraft against tidal action allows mooring lines to remain snug with minimal slack therein while reducing roll and line shock generated by tidal action and maintaining the spatial position of the watercraft in a mooring slip during the occurrence of such tidal action.

10. The apparatus according to claim 9 wherein the bottom mounting bracket further comprises a gusset joined to the first section and the second section, wherein the gusset is substantially perpendicular to the first section and the second section.

* * * * *